United States Patent [19]

Hutson

[11] 4,165,123

[45] Aug. 21, 1979

[54] HIGH CHAIR APRON

[76] Inventor: Howard A. Hutson, P.O. Box 1415, Denver, Colo. 80201

[21] Appl. No.: 879,137

[22] Filed: Feb. 21, 1978

[51] Int. Cl.[2] ..... A47D 15/00

[52] U.S. Cl. ..... 297/153; 297/182; 108/26

[58] Field of Search ..... 297/148–155, 297/182; 108/25, 26

[56] References Cited

U.S. PATENT DOCUMENTS

| | | | |
|---|---|---|---|
| 1,050,205 | 1/1913 | Conley | 297/182 |
| 1,178,894 | 4/1916 | Wilcox | 297/153 |
| 1,309,343 | 7/1919 | Thomas | 297/182 |
| 2,540,685 | 2/1951 | Mayer | 297/182 |
| 2,827,953 | 3/1958 | Jones | 297/182 |
| 3,369,835 | 2/1968 | Telarico | 297/150 |
| 3,788,699 | 1/1974 | Starr | 297/153 X |

*Primary Examiner*—Roy D. Frazier
*Assistant Examiner*—Peter A. Aschenbrenner
*Attorney, Agent, or Firm*—Sheridan, Ross, Fields & McIntosh

[57] ABSTRACT

A disposable high chair apron used to cover and enlarge a high chair eating tray. The periphery of the apron is provided with a deep trough which is used to catch any food or other spillage. A suitable connection behind the seat of the high chair secures the apron to the chair.

8 Claims, 6 Drawing Figures

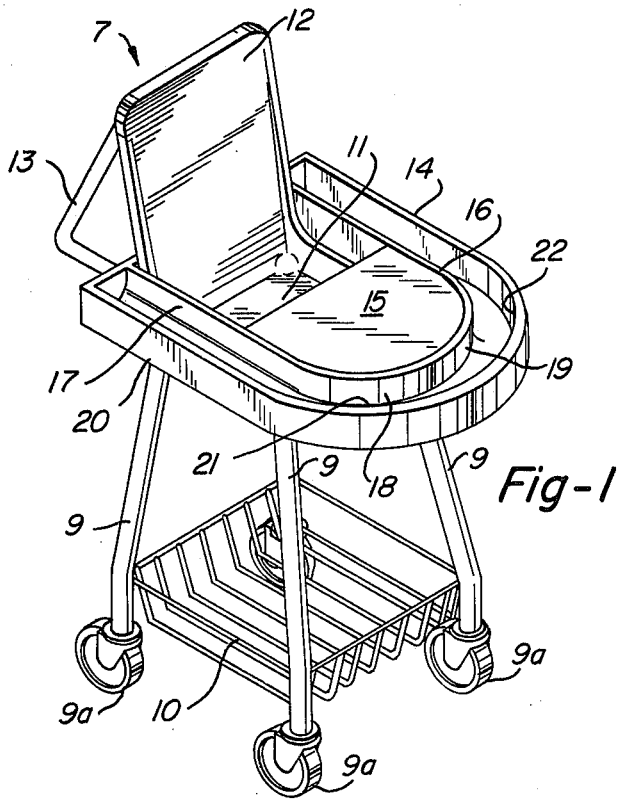
Fig-1
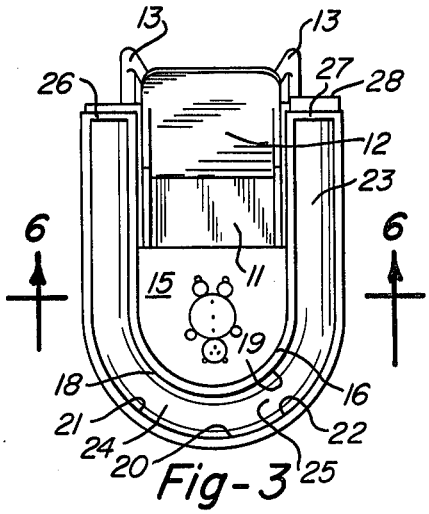
Fig-3
Fig-5
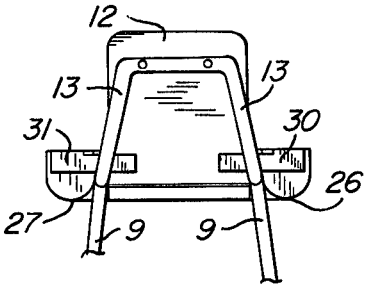
Fig-6
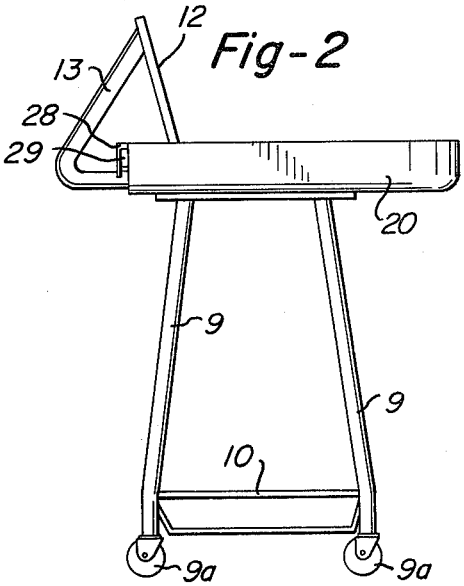
Fig-2
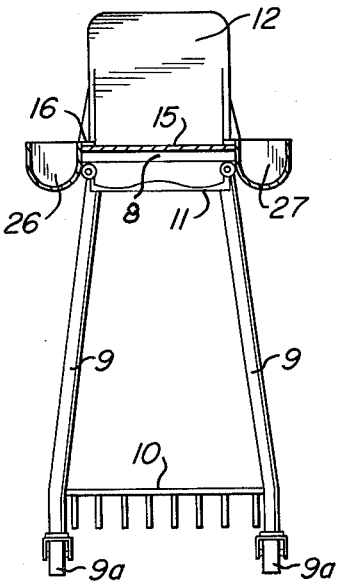
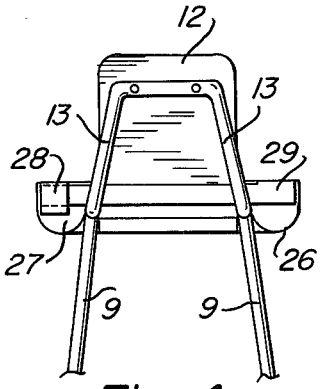
Fig-4

HIGH CHAIR APRON

BACKGROUND OF THE INVENTION

1. Field of the Invention

This invention is in the field of disposable high chair attachments. The object of such attachments is to catch and retain food or spillage while providing a sanitary surface for a young child and his food. Additionally, the attachment surface area may include decorative indicia to entertain the child.

2. Description of the Prior Art

Prior to the present invention various types of high chair aprons have been proposed for the catching of food or other spillage. Most of the previous aprons, however, do not provide a cover for the high chair tray itself and, therefore, the tray must be cleaned separately after each use along with the apron. Also, one of the prior catching devices is attached to the chair by means of screw eyes which are embedded into the chair. Such fastening means is not readily adaptable to modern high chairs made of metal. In addition, some of the aprons comprise a number of separate parts and, therefore, must be assembled prior to their use and disassembled for cleaning purposes. Furthermore, none of the high chair aprons previously disclosed can be inexpensively disposed of after a single use and so all such aprons must eventually be cleaned.

Therefore, it would be beneficial to provide a high chair apron for catching spillage without the necessity of constantly cleaning the catching apron. In particular, in commercial eating establishments where high chairs are provided for the feeding of young children, the high chair eating surface may be inadequately cleaned after being used because of the expense involved. The young child may, then, not have a sanitary eating surface. Thus, a disposable high chair apron can be utilized thereby reducing the considerable time and expense involved in this cleaning operation and, more importantly, assure the child of a sanitary eating surface.

3. Prior Art Statement

| Inventor | U.S. Pat. No. |
|---|---|
| Nelson | 2,526,576 |
| Mayer | 2,540,685 |
| Caponera | 2,585,434 |
| Williams | 2,700,413 |
| Decker | 3,298,736 |
| McKee | 3,493,122 |

The Nelson patent (U.S. Pat. No. 2,526,576) discloses an auxiliary tray adapted to rest between the edge of a high chair tray and a child occupying the high chair.

The Mayer patent (U.S. Pat. No. 2,540,685) discloses an attachment to the tray of the high chair. The device includes a wire frame extending through a hemmed, leak-proof material. Screw eyes are embedded into the side of the high chair to secure the wire frame to the chair.

The Caponera patent (U.S. Pat. No. 2,585,434) discloses a "catchall" attached to the bottom leg area of a chair.

The Williams patent (U.S. Pat. No. 2,700,413) describes a textile spread adapted to fit and surround a chair frame.

The Decker patent (U.S. Pat. No. 3,298,736) discloses a removable high chair attachment that includes frame members which support a drop catch. The drop catch is fastened on the legs of the chair.

The McKee patent (U.S. Pat. No. 3,493,122) shows a disposable serving tray made of corrugated cardboard.

SUMMARY OF THE INVENTION

The present invention provides a disposable high chair apron that is both inexpensive to produce and can be disposed of after a single use. The apron comprises a generally U-shaped trough at the apron's periphery; a generally rectangular surface that rests upon the tray of the high chair and is capable of displaying decorative indicia; and a narrow rim surface that rests upon the tray and arms of the high chair. The disposable high chair apron also includes a means for securing the apron to the back of the high chair.

It is, therefore, an object of the present invention to provide a simple and efficient apron for catching food or other items that are spilled by a child occupying a high chair.

It is another object of the present invention to provide an apron which is disposable after one use and which provides a surface upon which advertising or other decorative indicia may be applied.

It is another object of the present invention to provide an apron which is inexpensive to produce, lightweight, and easily attached to a high chair and removable therefrom.

BRIEF DESCRIPTION OF THE DRAWINGS

Other objects, features and advantages of the invention will be readily apparent in the following description, taken in conjunction with the accompanying drawings, although variations and modifications may be effected without departing from the spirit and scope of the novel concepts of the disclosure, and in which:

FIG. 1 is a perspective view of the apron attached to a high chair;

FIG. 2 is a side elevational view of the apron attached to a high chair;

FIG. 3 is a top plan view of the apron attached to a high chair;

FIG. 4 is a rear view of an embodiment of the apron attached to a high chair showing the attachment strip positioned behind the chair;

FIG. 5 is a rear view of another embodiment for attaching the apron to a high chair;

FIG. 6 is a cross-sectional view of the apron and chair taken on the line 6—6 of FIG. 3.

DESCRIPTION OF THE EMBODIMENT

FIG. 1 shows a high chair 7 which includes chair legs 9, roller casters 9*a*, and a parcel rack 10 which connects with the chair legs 9; seat 11 which is supported by the chair legs 9 and the parcel rack 10; back and arms 12 which connect with the edge of the seat 11; and support handles 13 which are secured to the back of the chair and which provide a grip for moving and maneuvering the high chair.

Also depicted in FIG. 1 is a generally U-shaped trough-like apron 14 which is formed from a generally lightweight rigid material such as egg carton material or the like. Apron 14 includes a generally rectangular surface 15, integrally embodied within narrow rim surface 16, which rests upon the tray 8 of the high chair 7. The narrow rim surface 16 extends around and beyond the generally rectangular surface 16 to the high chair back 12. Adjacent to and integrally connected with the narrow rim surface 16 is an inner trough member 17. Inner trough member 17 includes rounded corners 18 and 19.

As FIG. 2 shows, apron 14 also includes an outer trough member 20 which is generally parallel to and spaced from inner trough member 17. Outer trough member 20 includes rounded corners 21 and 22. FIG. 3 shows bottom trough member 23 and outer trough member 20. Bottom trough member 23 includes rounded corners 24 and 25. Finally, apron 14 includes upright end surfaces 26 and 27, as shown in FIG. 6, which integrally connect with inner trough member 17, outer trough member 20, and bottom trough member 23 at the end of apron 14.

Apron 14 is placed upon the high chair 7. FIG. 4 depicts an embodiment that removably secures the apron 14 to the high chair 7. In this embodiment, locking flap 28 is integrally connected with upright end surface 27. Attachment strip 29 is integrally connected with upright end surface 26. Connecting attachment strip 29 with locking flap 28 secures apron 14 behind the back 12 of the high chair 7.

FIG. 5 provides another embodiment which quickly secures apron 13 to the high chair 7. In this embodiment, holding members 30 and 31, integrally connected with upright end surfaces 26 and 27, respectively, are folded behind the back 12 of the high chair 7 thereby securing the apron 14 to the high chair 7.

In the above described structure a lightweight and inexpensive high chair apron, which is sufficiently rigid to support articles thereupon, has been provided. Additionally, a high chair apron has been provided which is formed from a material which readily accepts advertising or other decorative indicia. Also, due to the inexpensive material from which the high chair is formed, it may be used once and then discarded. For safety purposes, the high chair apron can be formed from a material which has been subjected to fireproofing treatment.

It will be evident that various modifications can be made to the described embodiment without departing from the scope of the present invention.

What is claimed is:

1. A disposable apron for a high chair, said high chair having a seat, chair back, and arms with a tray supported on said arms, said apron comprising (a) a generally planar surface member which is positioned to overlie and be supported by said tray, (b) a trough means positioned around at least three edges of said planar surface member and having a pair of ends, said trough means being arranged to catch and hold food or liquids which are dropped by a child sitting in the high chair, (c) means for securing said apron to said high chair, said securing means being attached to the trough means at a location near the back of said chair and arranged to extend behind said back to secure the apron, and (d) a narrow rim surface disposed between said planar surface member and said trough means, said narrow rim surface being elevated slightly above said surface member to form a ridge around at least three edges of the surface member.

2. The structure of claim 1 wherein said trough means includes an inner trough member arranged around and connected to the edges of the narrow rim surface, bottom trough member and outer trough member, said inner, outer and bottom trough members being connected together along their entire length to form a U-shaped cross section having a generally deep vertical dimension for holding substantial quantities of food, said trough means in plan also being U-shaped with the free ends of said trough means extending to a point near each side of said chair back.

3. The structure of claim 2 wherein the ends of the trough means include end surfaces joined to seal the ends of said trough means to retain food therein.

4. The structure of claim 1 wherein said trough means is formed from a generally rigid lightweight material that has been subjected to fire proofing treatment.

5. The structure of claim 1 wherein said rectangular surface member, said trough means and said securing means are formed integrally as a one-piece unit.

6. The structure of claim 1 wherein an upper surface of said rectangular surface member has an attractive design therein which will attract and hold the attention of a child sitting in the high chair.

7. A disposable apron for a high chair, said chair having a seat, chair back, and arms with a tray supported on said arms, said apron comprising (a) a generally planar surface member which is positioned to overlie and be supported by said tray, (b) a trough means positioned around at least three edges of said planar surface member and having a pair of ends, said trough means being arranged to catch and hold food or liquids which are dropped by a child sitting in the high chair, and (c) means for securing said apron to said high chair, said securing means being attached to the trough means at a location near the back of said chair and arranged to extend behind said back to secure the apron, (d) said securing means including a locking flap connected to one of said ends of the trough means and an attachment strip connected to the other end of the trough means and arranged to extend behind the back of said high chair and connect to the locking flap.

8. A disposable apron for high chairs, said chair having a seat, chair back, and arms with a tray supported on said arms, said apron comprising (a) a generally planar surface member which is positioned to overlie and be supported by said tray, (b) a trough means positioned around at least three edges of said planar surface member and having a pair of ends, said trough means being arranged to catch and hold food or liquids which are dropped by a child sitting in the high chair, and (c) means for securing said apron to said high chair, said securing means being attached to the trough means at a location near the back of said chair and arranged to extend behind said back to secure the apron, (d) said securing means including a pair of foldable holding members, each of said holding members being attached to one of said ends of said trough means, each of said holding members being arranged to fold toward each other and behind at least the edge of the back of the chair to hold said apron to said chair.

* * * * *